US006264174B1

(12) United States Patent
Chang et al.

(10) Patent No.: US 6,264,174 B1
(45) Date of Patent: Jul. 24, 2001

(54) HIGH PRESSURE TANK FOR AN EMULSIFIER

(76) Inventors: Tsun Shin Chang, No. 128-3, Ta Jung E. St., Hsi Tun Dist., Taichung; Shih Ching Chuang, 6Fl., No. 23, Lane 308, Kung Fu S. Rd., Taipei, both of (TW)

( * ) Notice: Subject to any disclaimer, the term of this patent is extended or adjusted under 35 U.S.C. 154(b) by 0 days.

(21) Appl. No.: 09/477,066

(22) Filed: Jan. 4, 2000

(51) Int. Cl.[7] ..... B01F 3/04

(52) U.S. Cl. ..... 261/29; 261/36.1; 261/76; 261/DIG. 75

(58) Field of Search ..... 261/28, 29, 36.1, 261/76, DIG. 75

(56) References Cited

U.S. PATENT DOCUMENTS 2,020,850 * 11/1935 Myhren et al. ..... 261/76
2,127,571 * 8/1938 Pardee, Jr. ..... 261/DIG. 75
2,521,215 * 9/1950 Haddeland et al. ..... 261/DIG. 75
4,208,375 * 6/1980 Bard ..... 261/76 X
5,080,802 * 1/1992 Cairo, Jr. et al. ..... 261/DIG. 75
5,756,012 * 5/1998 McGlashan et al. ..... 261/DIG. 75
5,772,731 * 6/1998 Harrison ..... 261/DIG. 75
5,814,210 * 9/1998 Yoon et al. ..... 261/DIG. 75
5,824,243 * 10/1998 Contreras ..... 261/36.1
5,951,921 * 9/1999 Koganezawa et al. ..... 261/36.1
5,968,352 * 10/1999 Ditzler ..... 261/76 X
6,054,046 * 4/2000 Nelson ..... 261/DIG. 75

* cited by examiner

*Primary Examiner*—Richard L. Chiesa
(74) *Attorney, Agent, or Firm*—Bacon & Thomas, PLLC

(57) ABSTRACT

A high pressure tank installed in an emulsifier and connected between a bubble generator and a water pipe to receive a liquid from a water pump for enabling the liquid to be delivered to the bubble generator for making bubbles, the high pressure tank having a venturi tube extended from one side thereof to the water pipe for enabling a part of the liquid to be guided out of the high pressure tank to the water pipe for circulation, and an air valve installed in the venturi tube for enabling outside air to be drawn into the venturi tube to mix with the liquid passing through.

1 Claim, 4 Drawing Sheets

HIGH PRESSURE TANK FOR AN EMULSIFIER

BACKGROUND OF THE INVENTION

The present invention relates to an emulsifier, and more specifically to a high-pressure tank for use in an emulsifier, which uses a venturi tube and an air valve to guide outside air into the liquid passing through.

In an emulsifier, a high pressure tank 12 is connected between a bubble generator 11 and a water pipe 14, a water pump 141 is controlled to pump a liquid from the water pipe 14 into the high pressure tank 12, and an air pump 151 is controlled to pump air through an air pipe 15 into the high pressure tank 12 for mixing with the liquid, enabling the mixture to be further delivered to the bubble generator 11. The high-pressure tank 12 further comprises a relief valve 13 at the top for output of excessive high pressure. Because the air and the liquid have different pressures, they cannot be well mixed in the high-pressure tank 12.

SUMMARY OF THE INVENTION

The present invention eliminates the aforesaid problem. According to the present invention, a venturi tube is connected between the high pressure tank and the water pipe for circulation of the liquid, and an air valve is installed in the venturi tube to let outside air be drawn into the venturi tube for mixing with the liquid. The air mixed liquid is guided into the water pipe, and then pumped by the water pump into the high-pressure tank again. This arrangement eliminates the installation of the air pump and air pipe as used in the prior art design, and enables air to be well mixed with the liquid.

DETAILED DESCRIPTION OF THE PREFERRED EMBODIMENT

Figure 1:
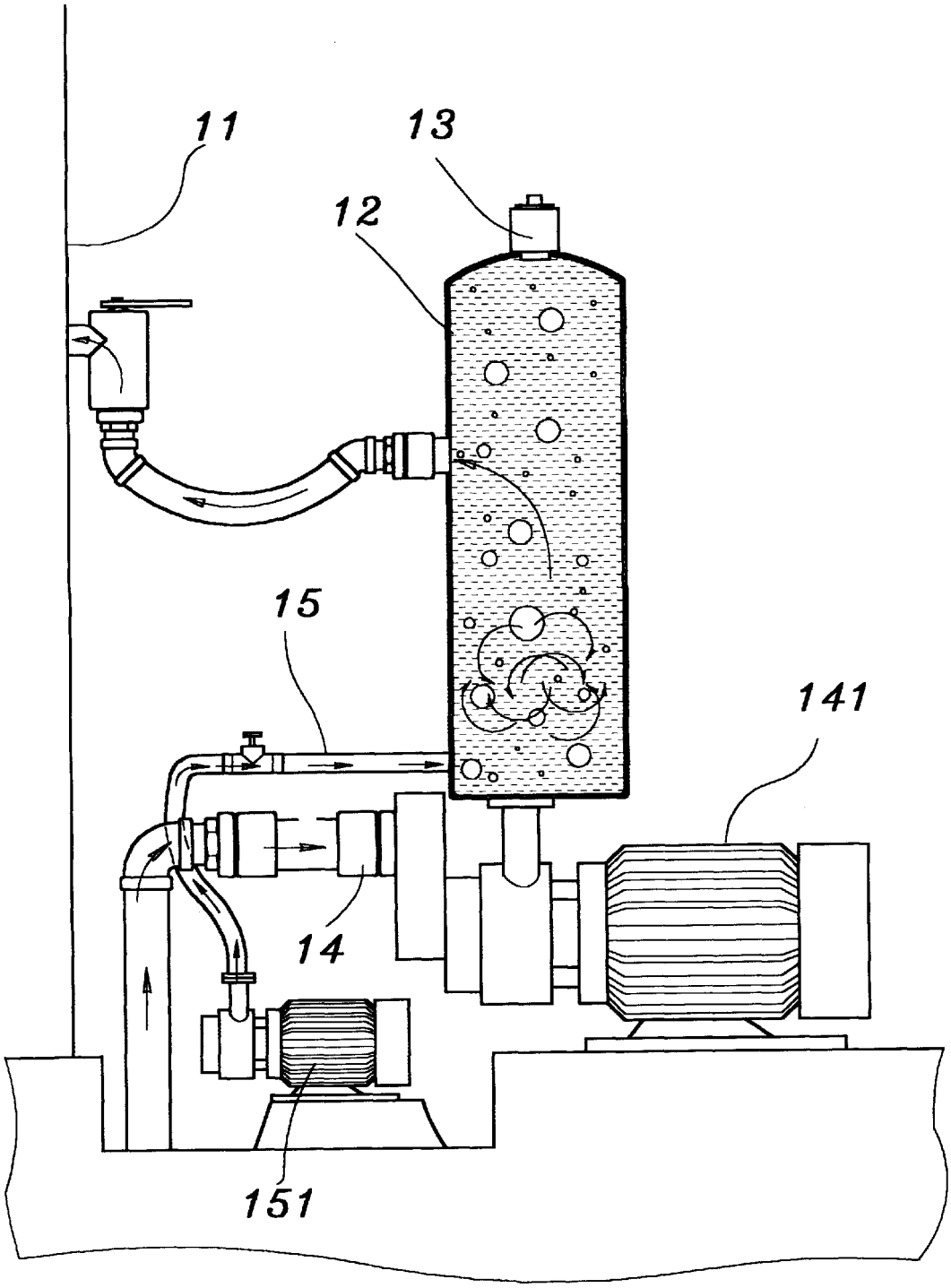
PRIOR ART FIG. 1
FIG. 1 illustrates a high-pressure tank installed in an emulsifier according to the prior art.
Figure 2:
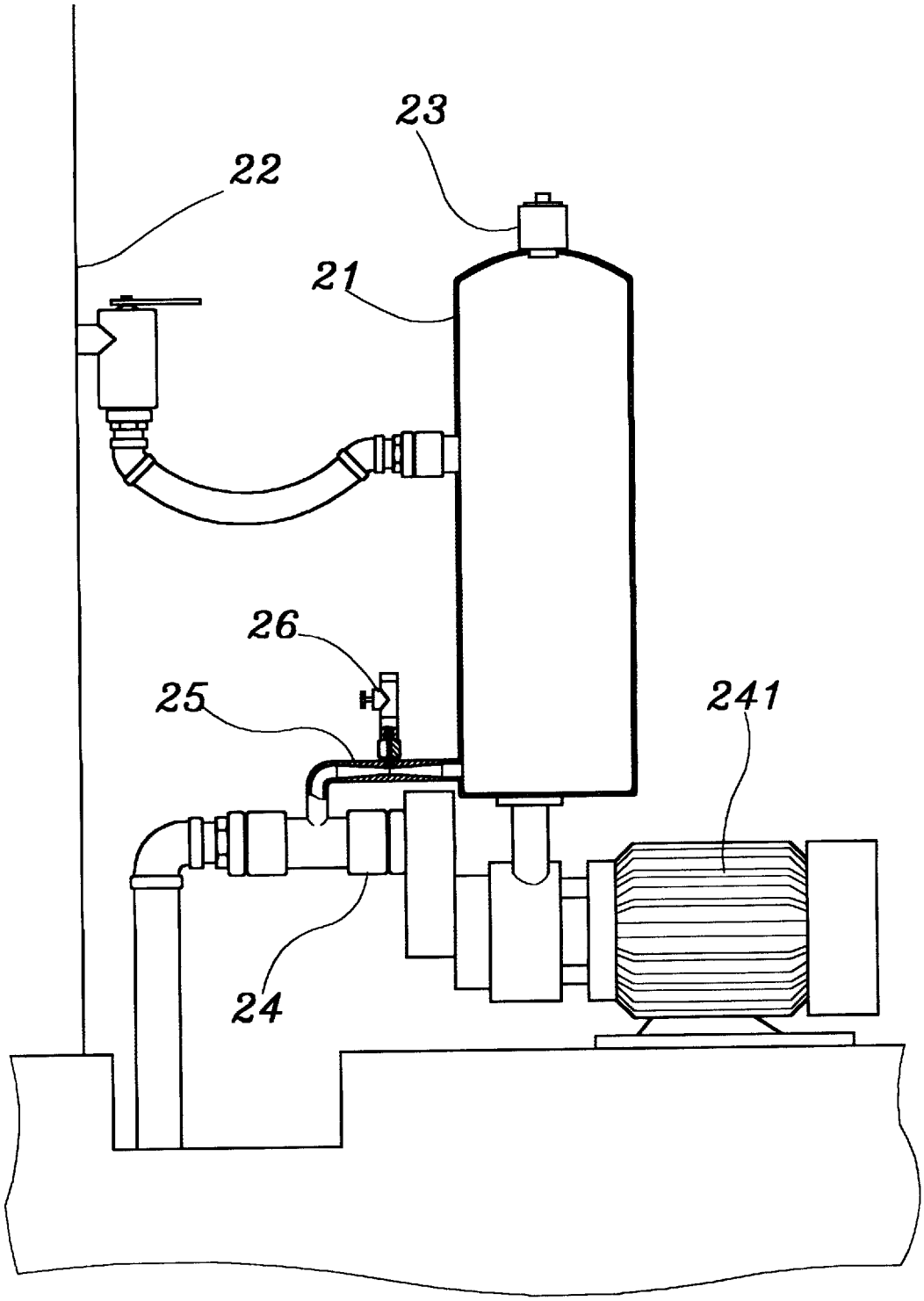
FIG. 2 illustrates a high-pressure tank installed in an emulsifier according to the present invention.

Referring to FIG. 2, a high pressure tank 21 is installed in an emulsifier and connected to a bubble generator 22, having a relief valve 23 disposed at the top side thereof, and a guide tube 25 disposed at the bottom side thereof and connected to a water pipe 24, which has one end connected to a liquid source and an opposite end connected to a water inlet (not shown) on the bottom side wall of the high pressure tank 21. The guide tube 25 is a venturi tube having a tapering construction in the middle, and an air valve 26 connected to the double-tapered construction for enabling outside air to be drawn into the guide tube 25 to mix with the liquid passing through. When the water pump, referenced by 241, is started, a liquid is pumped through the water pipe 24 into the high-pressure tank 21, and at the same time outside air is sucked into the guide tube 25 to mix with the liquid for making bubbles.

Figure 3:
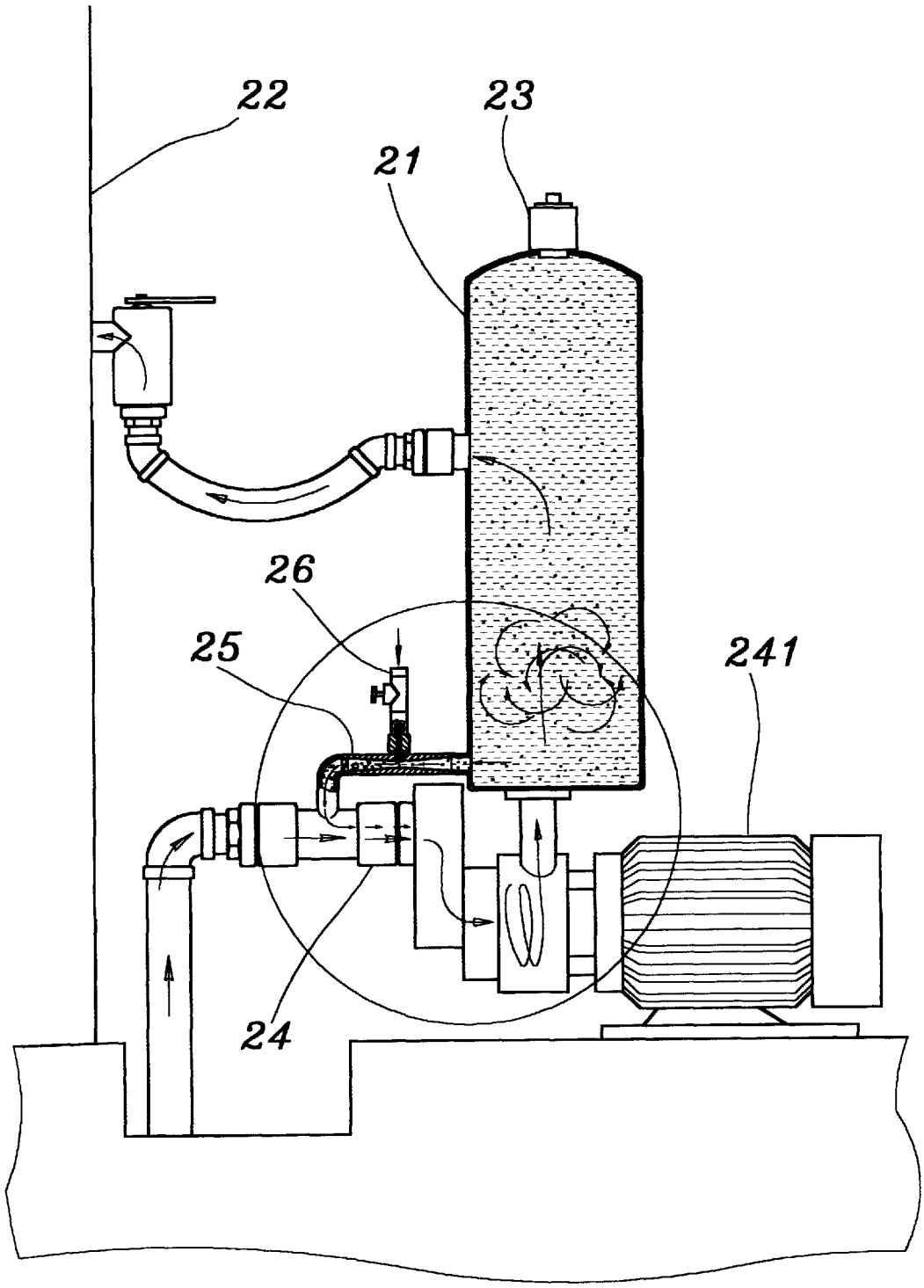
FIG. 3 shows the flowing direction of the liquid through the high-pressure tank according to the present invention.
Figure 4:
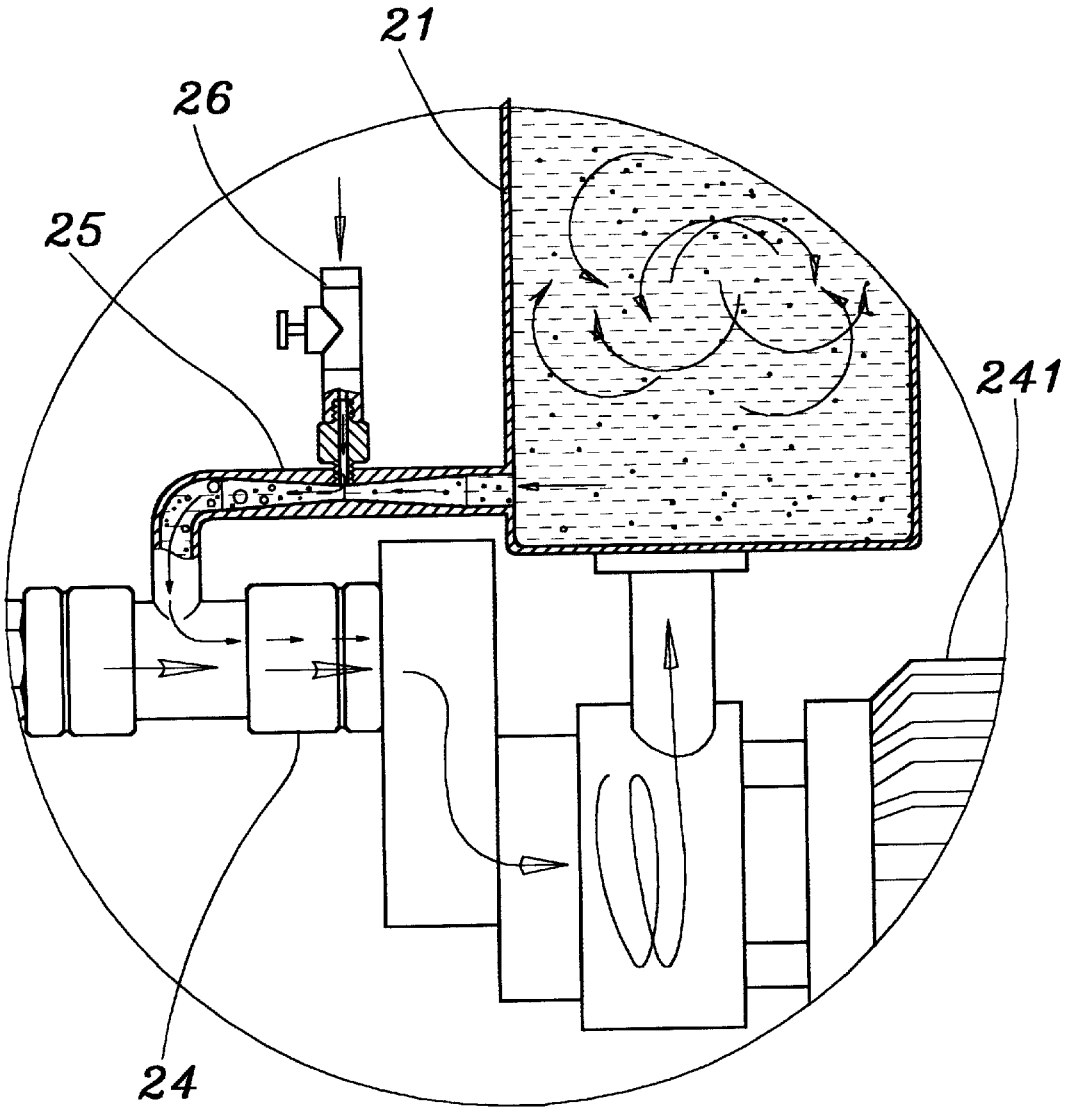
FIG. 4 is an enlarged view of a part of FIG. 3.

Referring to FIGS. 3 and 4, the pump 241 continuously pumps the liquid into the high pressure tank 21, a part of the liquid flows out of the high pressure tank 21 through the guide tube 25 to the water pipe 24, causing outside air to be drawn through the air valve 26 into the guide tube 25 to mix with the liquid and to slow down the velocity of the liquid. The air mixed liquid is further pumped into the high-pressure tank 21 by the pump 241, and guided to the bubble generator 22.

As indicated above, a venturi tube is provided to guide the liquid out of the high-pressure tank 21 for mixing with air, and the air mixed liquid is then pumped into the high-pressure tank 21 and then guided to the bubble generator 22 for making bubbles.

While only one embodiment of the present invention has been shown and described, it will be understood that various modifications and changes could be made thereunto without departing from the spirit and scope of the invention disclosed.

What the invention claimed is:

1. A high pressure tank installed in an emulsifier, having a top end connected to a bubble generator and a bottom end connected to a water pipe to receive a liquid from a water pump for enabling the liquid to be delivered to said bubble generator for making bubbles, wherein a venturi tube is extended from said high pressure tank and connected to said water pipe for enabling a part of the liquid to be guided out of said high pressure tank to said water pipe for circulation, and an air valve is installed in said venturi tube on the middle for enabling outside air to be drawn into said venturi tube to mix with the liquid passing through.

* * * * *